United States Patent [19]

Ramacciotti

[11] 3,984,231

[45] Oct. 5, 1976

[54] PROCESS FOR THE TWO-STAGE REDUCTION OF IRON ORE IN A ROTARY KILN

[75] Inventor: Aldo Ramacciotti, Rome, Italy

[73] Assignee: Centro Sperimentale Metallurgico S.p.A., Rome, Italy

[22] Filed: Jan. 21, 1976

[21] Appl. No.: 650,985

[30] Foreign Application Priority Data

Jan. 21, 1975 Italy ..... 47770/75

[52] U.S. Cl. ..... 75/38; 75/40

[51] Int. Cl.[2] ..... C21B 11/06

[58] Field of Search ..... 75/38, 40, 93 R, 61

[56] References Cited

UNITED STATES PATENTS

| | | | |
|---|---|---|---|
| 2,862,811 | 12/1958 | Eketorp et al. | 75/61 X |
| 3,092,490 | 6/1963 | Ednie | 75/40 X |
| 3,511,644 | 5/1970 | Josetsson et al. | 75/40 |
| 3,833,355 | 9/1974 | Ramacciotti | 75/40 |

*Primary Examiner*—M. J. Andrews

*Attorney, Agent, or Firm*—Young & Thompson

[57] ABSTRACT

A process for the two-stage reduction of iron ore in a rotary kiln, which is an improvement on U.S. Pat. No. 3,833,355. A layer of reducing agent such as coke is held against the side wall of a reactor that rotates about its vertical axis, by centrifugal force and its own friction. The next inner layer is a layer of iron ore. The improvement over the earlier patent is that reduction is conducted in two stages comprising a first relatively low temperature stage of 1 to 4 hours at 700° to 1100°C., which does not melt the ore, and a second relatively high temperature stage of 0.5 to 1.5 hours at 1450° to 1550°C., with removal of the reduced carburized liquid iron from the bottom of the reactor during the second stage.

5 Claims, No Drawings

PROCESS FOR THE TWO-STAGE REDUCTION OF IRON ORE IN A ROTARY KILN

The present invention relates to the reduction of material containing iron in an oxidized state, in a rotary vessel, for the production of liquid carburized iron by means of direct reduction of material containing iron in an oxidized state, for example iron ore.

This invention is an improvement over that of my earlier U.S. Pat. No. 3,833,355, issued Sept. 3, 1975, the disclosure of which is incorporated herein by reference.

My earlier patent dealt with a controlled process for the production of liquid carburized iron, in a reactor or furnace which rotates about its own vertical axis, starting from materials containing oxidized iron and preliminarily heated above the melting point. That earlier patent dealt with the feeding of the solid materials to the reactor in a certain manner so as to produce a particular distribution of the charge materials within the reactor. Specifically, the reducing agent such as coke, and the iron ore, were not introduced into the reactor as a mixture but separately, the first or outer layer against the reactor wall being coke and the next inner layer being iron ore.

The centrifugal force of the rotating vessel maintained the charged materials against the side walls thereof and thus maintained the materials in their stratified condition by friction and centrifugal force.

By the arrangement of the materials with the coke to some extent protected from the hot gases by the layer of iron ore, it is possible to heat the charge using the sensible heat of the hot gases produced by combustion of the gases that are emitted during the reduction reaction, without burning the reducing agent.

It was a feature of my earlier patent that the reduction take place between the layer of melted oxide and the underlying layer of reducing agent. But the endothermic nature of the reducing reaction, and the high heat needed to melt the iron ore, made it necessary to supply a great amount of heat to the reacting materials.

Accordingly, it is an object of the present invention to provide a method of the general nature of my previously-patented method, but characterized by a considerable fuel saving.

Briefly, the object of the invention is achieved by conducting the heating of the material in the reactor, and hence the reduction reaction, in two stages characterized by different temperatures. In the first or low temperature stage, the material is heated and reduced while in solid phase, at temperatures between 700° and 1100°C., without melting. In the second or high temperature stage, the material which was and operating largely reduced in the previous stage, is melted, completing at the same time, if necessary, its reduction.

In a preferred embodiment of the invention, the first stage of heating is conducted in a plurality of reactors at the same time that the second stage of heating is simultaneously conducted in a further plurality of reactors, the same reactor switching between first stage heating and second stage heating substantially simultaneously with at least one other reactor. In this way, it is possible to use the off-gases from those reactors that are operating in the second stage, to preheat the gases and materials introduced into the reactors that are on first stage. Of course, as the duration of the first stage need not be and ordinarily will not be the ame as the duration of the second stage, the numbers of reactors engaged in either of the two stages will be proportional to the duration of the stage.

Also in a preferred embodiment, the gas fed to the first stage is air; while that fed to the second stage is air enriched in oxygen, preferably commercially pure oxygen, thereby to conduct the second stage at a higher temperature than the first stage. Of course, material is supplied to the reactor during first stage reduction in accordance with my earlier patent; but no solid material is fed to the reactor during the second stage.

First stage reduction is conducted at a temperature of 700° to 1100°C. for a period of time of 1 to 4 hours; while the second stage is conducted at a temperature of 1450°–1550°C. for a period of time of 0.5 to 1.5 hours, the increased temperature of the second stage being due to increased oxygen flow and decreased nitrogen flow.

To enable those skilled in this art to practice the invention, the following illustrative example is given:

Three cylindrical steel vessels having the same dimensions and rotating at the same speed as in my earlier patent, are fed with coke, and with a mixture of 0.13 kg of auxiliary coke per kg of iron ore, and with lime, all as in my earlier patent. However, the gas supplied to the vessel in the first stage is air preheated to 500°C. at a flow rate of 240 $Nm^3/h$, the rate of coke feed being 1.6 kg/min and the rate of feeding the mixture of 0.13 kg of auxiliary coke per kg of ore being 4 kg/min, the lime being fed at a rate of 1.5 kg/min.

The air blowing is continued for two hours and the materials in the vessel having a temperature of 1100°C. At the end of 2 hours, the air feed is discontinued and commercially pure oxygen is blown in at a rate of 60 $Nm^3/h$ for one hour, during which the materials have a temperature of 1500°C. During second stage, the reduced carburized iron, in liquid phase, is withdrawn through the lower central portion of the vessel at a flow rate of 4 kg/min, with a carbon content of about 1%.

The three vessels are operated seriatim, so that one is in the first hour of the first stage, the next in the second hour of the first stage, and the third in the second stage. The off-gases from the second stage are passed in indirect heat exchange with the air to the first stage and then in direct heat exchange with the coke fed to the first stage. Each hour, two of the vessels are shifted, the second-stage vessel being switched to the first hour of first stage and the vessel in which the second hour of the first stage had previously been conducted being switched to second stage, so that the second stage operation moves from one vessel to the next once an hour.

From a consideration of the foregoing disclosure, therefore, it will be evident that the initially recited object of the invention has been achieved.

Although the present invention has been described and exemplified in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a process for the production of liquid carburized iron by direct reduction of iron-containing materials in a substantially cylindrical vertical reactor by introducing material containing iron in oxidized state and a carbonaceous reducing material into said reactor while rotating said reactor about a vertical axis at a speed sufficient to maintain said materials against the reactor wall by centrifugal force, removing molten iron from the lower end of the reactor, feeding the material containing iron in an oxidized state after feeding the carbonaceous reducing material into the reactor to obtain alternate layers with the layer next to the reactor wall being substantially all a carbonaceous reducing material and the next adjacent layer disposed nearer said axis and consisting essentially of material containing iron in an oxidized state, and introducing oxygen-containing gas into the reactor to burn to carbon dioxide the carbon monoxide product of reduction of said material containing iron in an oxidized state; the improvement comprising conducting said reduction in two sequential stages, the material in the reactor being at a temperature of 700° to 1100°C. for the first of said two stages for a time of 1 to 4 hours, and the material in the reactor being at a temperature of 1450° to 1550°C. for a time of 0.5 to 1.5 hours during the second of said stages.

2. A process as claimed in claim 1, conducted in a plurality of reactors, said first stage being conducted in a plurality of reactors simultaneously as said second stage is conducted in at least one other reactor, and periodically and cyclicly switching said reactors back and forth between said first and second stages.

3. A process as claimed in claim 2, and preheating said gas introduced into said reactors in said first stage by indirect heat exchange with gas from said at least one reactor in said second stage.

4. A process as claimed in claim 1, in which said gas in said first stage is air and said gas in said second stage is a gas richer in oxygen than is air.

5. A process as claimed in claim 4, in which said gas in said second stage is commercially pure oxygen.

* * * * *